US010373629B2

(12) United States Patent
Liu et al.

(10) Patent No.: US 10,373,629 B2
(45) Date of Patent: Aug. 6, 2019

(54) AUDIO SIGNAL ENCODING AND DECODING METHOD, AND AUDIO SIGNAL ENCODING AND DECODING APPARATUS

(71) Applicant: HUAWEI TECHNOLOGIES CO., LTD., Shenzhen, Guangdong (CN)

(72) Inventors: Zexin Liu, Beijing (CN); Bin Wang, Beijing (CN); Lei Miao, Beijing (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 15/717,952

(22) Filed: Sep. 28, 2017

(65) Prior Publication Data

US 2018/0018989 A1 Jan. 18, 2018

Related U.S. Application Data

(63) Continuation of application No. 14/704,502, filed on May 5, 2015, now Pat. No. 9,805,736, which is a (Continued)

(30) Foreign Application Priority Data

Jan. 11, 2013 (CN) ..... 2013 1 0010936

(51) Int. Cl.
*G10L 19/00* (2013.01)
*G10L 21/00* (2013.01)
(Continued)

(52) U.S. Cl.
CPC ..... *G10L 21/0388* (2013.01); *G10L 19/08* (2013.01); *G10L 19/265* (2013.01);
(Continued)

(58) Field of Classification Search
CPC ..... G10L 21/038; G10L 19/04; G10L 19/12; G10L 19/09; G10L 19/083; G10L 21/0232
See application file for complete search history.

(56) References Cited

U.S. PATENT DOCUMENTS 5,455,888 A 10/1995 Iyengar et al.
6,615,169 B1 * 9/2003 Ojala ..... G10L 19/012 704/205
(Continued)

FOREIGN PATENT DOCUMENTS

CN 1328681 A 12/2001
CN 1484824 A 3/2004
(Continued)

OTHER PUBLICATIONS

Epps, J., et al., "Speech Enhancement Using STC-Based Bandwidth Extensions," The 5th International Conference on Spoken Language Processing, Incorporating the 7th Australian International Speech Science and Technology Conference, Nov. 30-Dec. 4, 1998, 4 pages. XP007000515A.
(Continued)

*Primary Examiner* — Olujimi A Adesanya
(74) *Attorney, Agent, or Firm* — Huawei Technologies Co., Ltd.

(57) ABSTRACT

An audio signal encoding and decoding method, an audio signal encoding and decoding apparatus, a transmitter, a receiver, and a communications system, which can improve encoding and/or decoding performance. The audio signal encoding method includes dividing a to-be-encoded time domain signal into a low band signal and a high band signal; encoding the low band signal to obtain a low frequency encoding parameter; calculating a voiced degree factor, and predicting a high band excitation signal; weighting the high band excitation signal and random noise using the voiced
(Continued)

degree factor, so as to obtain a synthesized excitation signal; and obtaining a high frequency encoding parameter based on the synthesized excitation signal and the high band signal. Technical solutions in the embodiments of the present invention can improve an encoding or decoding effect.

12 Claims, 7 Drawing Sheets

Related U.S. Application Data continuation of application No. PCT/CN2013/079804, filed on Jul. 22, 2013.

(51) Int. Cl.

| | |
|---|---|
| ***G10L 19/12*** | (2013.01) |
| ***G10L 21/0388*** | (2013.01) |
| ***G10L 21/038*** | (2013.01) |
| ***G10L 19/08*** | (2013.01) |
| ***G10L 19/26*** | (2013.01) |
| *G10L 25/93* | (2013.01) |
| *G10L 19/24* | (2013.01) |
| *G10L 19/02* | (2013.01) |

(52) U.S. Cl.

CPC ..... *G10L 21/038* (2013.01); *G10L 19/0204* (2013.01); *G10L 19/24* (2013.01); *G10L 25/93* (2013.01)

(56) References Cited

U.S. PATENT DOCUMENTS

| | | | | |
|---|---|---|---|---|
| 6,691,085 | B1 | 2/2004 | Rotola-Pukkila Jani et al. | |
| 6,795,805 | B1 | 9/2004 | Bessette et al. | |
| 6,807,524 | B1 | 10/2004 | Bessette et al. | |
| 8,374,856 | B2 | 2/2013 | Kim et al. | |
| 2004/0073421 | A1 | 4/2004 | Ansorge et al. | |
| 2004/0111257 | A1* | 6/2004 | Sung | G10L 19/173 704/219 |
| 2004/0128130 | A1 | 7/2004 | Rose et al. | |
| 2004/0181397 | A1 | 9/2004 | Gao | |
| 2005/0075867 | A1 | 4/2005 | Ansorge et al. | |
| 2005/0108007 | A1 | 5/2005 | Bessette et al. | |
| 2007/0282599 | A1 | 12/2007 | Choo et al. | |
| 2007/0299655 | A1 | 12/2007 | Laaksonen et al. | |
| 2008/0120118 | A1 | 5/2008 | Choo et al. | |
| 2009/0110208 | A1 | 4/2009 | Choo et al. | |
| 2009/0198498 | A1* | 8/2009 | Ramabadran | G10L 21/038 704/500 |
| 2009/0201983 | A1 | 8/2009 | Jasiuk et al. | |
| 2010/0100373 | A1* | 4/2010 | Ehara | G10L 19/26 704/219 |
| 2010/0198587 | A1 | 8/2010 | Ramabadran et al. | |
| 2010/0274558 | A1 | 10/2010 | Yamanashi et al. | |
| 2010/0286805 | A1 | 11/2010 | Gao et al. | |
| 2010/0318349 | A1 | 12/2010 | Kovesi et al. | |
| 2010/0324907 | A1 | 12/2010 | Virette et al. | |
| 2011/0099004 | A1 | 4/2011 | Krishnan et al. | |
| 2011/0282655 | A1 | 11/2011 | Endo | |
| 2012/0271644 | A1 | 10/2012 | Bessette et al. | |
| 2012/0316887 | A1 | 12/2012 | Oh et al. | |
| 2014/0046672 | A1 | 2/2014 | Liu et al. | |
| 2014/0149124 | A1 | 5/2014 | Choo et al. | |
| 2014/0214413 | A1* | 7/2014 | Atti | G10L 19/26 704/219 |
| 2014/0249807 | A1* | 9/2014 | Vaillancourt | G10L 25/93 704/207 |
| 2014/0257827 | A1 | 9/2014 | Norvell et al. | |
| 2015/0235653 | A1* | 8/2015 | Liu | G10L 21/0388 704/500 |
| 2015/0317994 | A1* | 11/2015 | Ramadas | G10L 19/08 704/226 |
| 2016/0196829 | A1 | 7/2016 | Liu et al. | |
| 2016/0203826 | A1* | 7/2016 | Kaniewska | G10L 21/038 704/500 |
| 2016/0240203 | A1* | 8/2016 | Lecomte | G10L 19/005 |

FOREIGN PATENT DOCUMENTS

| | | | |
|---|---|---|---|
| CN | 101083076 | A | 12/2007 |
| CN | 101183527 | A | 5/2008 |
| CN | 101188111 | A | 5/2008 |
| CN | 101236745 | A | 8/2008 |
| CN | 101256771 | A | 9/2008 |
| CN | 101414462 | A | 4/2009 |
| CN | 101572087 | A | 11/2009 |
| CN | 101996640 | A | 3/2011 |
| CN | 102800317 | A | 11/2012 |
| CN | 103928029 | A | 7/2014 |
| EP | 1111589 | A1 | 6/2001 |
| EP | 0870246 | B1 | 6/2007 |
| EP | 1926086 | A2 | 5/2008 |
| JP | H02230300 | | 9/1990 |
| JP | H0954600 | | 2/1997 |
| JP | 2002528776 | | 9/2002 |
| WO | 2009081568 | A1 | 7/2009 |
| WO | 2010070770 | A1 | 6/2010 |

OTHER PUBLICATIONS

Gustafsson, H., et al., "Speech Bandwidth Extension," HTML Paper, IEEE International Conference on Multimedia and Expo, Aug. 22-25, 2001 pp. 1016-1019. XP032177107A.

Gajjar et al, "Artificial Bandwidth Extension of Speech and Its Applications in Wireless Communication Systems: A Review," 2012 International Conference on Communication Systems and Network Technologies, Rajkot, 2012, pp. 563-568.

Fuchs et al, "A New Post-Filtering for Artificially Replicated High-Band in Speech Coders," 2006 IEEE International Conference on Acoustics Speech and Signal Processing Proceedings, Toulouse, 2006, pp. 713-716.

Bruno Bessette et al., The Adaptive Multirate Wideband Speech Codec (AMR-WB), IEEE Transactions on Speech and Audio Processing, vol. 10, No. 8, Nov. 2002, pp. 620-636.

Xia et al, Compressed domain speech enhancement method based on ITU-T G. 722.2, Speech Communication 55.5, Feb. 13, 2013. pp. 619-640.

CUI Shangping:"A Discussion About the Problem of Pre-Emphasis and De-Emphasis in FM Broadcast System", Journal of Gansu Sciences, vol. 13 No. 3, Sep. 2001. 7 pages With English abstract.

Kuang Yonghui:"Application of Pre-emphasis and De—Emphasis in Wireless Audio Device", Audio Engineering, Dec. 2012. 5 pages With English abstract.

* cited by examiner

AUDIO SIGNAL ENCODING AND DECODING METHOD, AND AUDIO SIGNAL ENCODING AND DECODING APPARATUS

CROSS-REFERENCE TO RELATED APPLICATIONS

This application is a continuation of U.S. patent application Ser. No. 14/704,502, filed on May 5, 2015, which is a continuation of International Application No. PCT/CN2013/079804, filed on Jul. 22, 2013. The International Application claims priority to Chinese Patent Application No. 201310010936.8, filed on Jan. 11, 2013. The disclosures of the aforementioned applications are hereby incorporated by reference in their entireties.

TECHNICAL FIELD

The present invention relates to the field of communications technologies, and in particular, to an audio signal encoding method, an audio signal decoding method, an audio signal encoding apparatus, an audio signal decoding apparatus, a transmitter, a receiver, and a communications system.

BACKGROUND

With continuous progress of communications technologies, users are imposing an increasingly high requirement on voice quality. Generally, voice quality is improved by increasing bandwidth of the voice quality. If a signal whose bandwidth is wider is encoded in a traditional encoding manner, a bit rate is greatly improved and as a result, it is difficult to implement encoding because of a limitation condition of current network bandwidth. Therefore, encoding needs to be performed on a signal whose bandwidth is wider in a case in which a bit rate is unchanged or slightly changed, and a solution proposed for this issue is to use a bandwidth extension technology. The bandwidth extension technology may be completed in a time domain or a frequency domain, and bandwidth extension is completed in the time domain in the present invention.

A basic principle of performing bandwidth extension in a time domain is that two different processing methods are used for a low band signal and a high band signal. For a low band signal in an original signal, encoding is performed at an encoder side according to a requirement using various encoders; at a decoder side, a decoder corresponding to the encoder of the encoder side is used to decode and restore the low band signal. For a high band signal, at the encoder side, an encoder used for the low band signal is used to obtain a low frequency encoding parameter so as to predict a high band excitation signal; a linear predictive coding (LPC) analysis, for example, is performed on a high band signal of the original signal to obtain a high frequency LPC coefficient. The high band excitation signal is filtered using a synthesis filter determined according to the LPC coefficient so as to obtain a predicted high band signal; the predicted high band signal is compared with the high band signal in the original signal so as to obtain a high frequency gain adjustment parameter; the high frequency gain adjustment parameter and the LPC coefficient are transferred to the decoder side to restore the high band signal. At the decoder side, the low frequency encoding parameter extracted during decoding of the low band signal is used to restore the high band excitation signal; the LPC coefficient is used to generate the synthesis filter; the high band excitation signal is filtered using the synthesis filter so as to restore the predicted high band signal; the predicted high band signal is adjusted using the high frequency gain adjustment parameter so as to obtain a final high band signal; the high band signal and the low band signal are combined to obtain a final output signal.

In the foregoing technology of performing bandwidth extension in a time domain, a high band signal is restored in a condition of a specific rate; however, a performance indicator is deficient. It can be learned by comparing a frequency spectrum of a restored output signal with a frequency spectrum of an original signal that, for a voiced sound of a general period, there is always an extremely strong harmonic component in a restored high band signal. However, a high band signal in an authentic voice signal does not have an extremely strong harmonic characteristic. Therefore, this difference causes that there is an obvious mechanical sound when the restored signal sounds.

An objective of embodiments of the present invention is to improve the foregoing technology of performing bandwidth extension in the time domain, so as to reduce or even remove the mechanical sound in the restored signal.

SUMMARY

Embodiments of the present invention provide an audio signal encoding method, an audio signal decoding method, an audio signal encoding apparatus, an audio signal decoding apparatus, a transmitter, a receiver, and a communications system, which can reduce or even remove a mechanical sound in a restored signal, thereby improving encoding and decoding performance.

According to a first aspect, an audio signal encoding method is provided, including dividing a to-be-encoded time domain signal into a low band signal and a high band signal; encoding the low band signal to obtain a low frequency encoding parameter; calculating a voiced degree factor according to the low frequency encoding parameter, and predicting a high band excitation signal according to the low frequency encoding parameter, where the voiced degree factor is used to indicate a degree of a voiced characteristic presented by the high band signal; weighting the high band excitation signal and random noise using the voiced degree factor, so as to obtain a synthesized excitation signal; and obtaining a high frequency encoding parameter based on the synthesized excitation signal and the high band signal.

With reference to the first aspect, in an implementation manner of the first aspect, the weighting the high band excitation signal and random noise using the voiced degree factor, so as to obtain a synthesized excitation signal may include performing, on the random noise using a pre-emphasis factor, a pre-emphasis operation for enhancing a high frequency part of the random noise, so as to obtain pre-emphasis noise; weighting the high band excitation signal and the pre-emphasis noise using the voiced degree factor, so as to generate a pre-emphasis excitation signal; and performing, on the pre-emphasis excitation signal using a de-emphasis factor, a de-emphasis operation for lowering a high frequency part of the pre-emphasis excitation signal, so as to obtain the synthesized excitation signal.

With reference to the first aspect and the foregoing implementation manner, in another implementation manner of the first aspect, the de-emphasis factor may be determined based on the pre-emphasis factor and a proportion of the pre-emphasis noise in the pre-emphasis excitation signal.

With reference to the first aspect and the foregoing implementation manners, in another implementation manner of the first aspect, the low frequency encoding parameter may include a pitch period, and the weighting the predicted high band excitation signal and random noise using the voiced degree factor, so as to obtain a synthesized excitation signal may include modifying the voiced degree factor using the pitch period; and weighting the high band excitation signal and the random noise using a modified voiced degree factor, so as to obtain the synthesized excitation signal.

With reference to the first aspect and the foregoing implementation manners, in another implementation manner of the first aspect, the low frequency encoding parameter may include an algebraic codebook, an algebraic codebook gain, an adaptive codebook, an adaptive codebook gain, and a pitch period, and the predicting a high band excitation signal according to the low frequency encoding parameter may include modifying the voiced degree factor using the pitch period; and weighting the algebraic codebook and the random noise using a modified voiced degree factor, so as to obtain a weighting result, and adding a product of the weighting result and the algebraic codebook gain and a product of the adaptive codebook and the adaptive codebook gain, so as to predict the high band excitation signal.

With reference to the first aspect and the foregoing implementation manners, in another implementation manner of the first aspect, the modifying the voiced degree factor using the pitch period may be performed according to the following formula:

$$\text{voice_fac_A} = \text{voice_fac} * \gamma$$

$$\gamma = \begin{cases} -a1 * T0 + b1 & T0 \le \text{threshold_min} \\ a2 * T0 + b2 & \text{threshold_min} \le T0 \le \text{threshold_max} \\ 1 & T0 \ge \text{threshold_max} \end{cases}$$

where voice_fac is the voiced degree factor, T0 is the pitch period, a1, a2, and b1>0, b2≥0, threshold_min and threshold_max are respectively a preset minimum value and a preset maximum value of the pitch period, and voice_fac_A is the modified voiced degree factor.

With reference to the first aspect and the foregoing implementation manners, in another implementation manner of the first aspect, the audio signal encoding method may further include generating a coded bitstream according to the low frequency encoding parameter and the high frequency encoding parameter, so as to send the coded bitstream to a decoder side.

According to a second aspect, an audio signal decoding method is provided, including distinguishing a low frequency encoding parameter and a high frequency encoding parameter in encoded information; decoding the low frequency encoding parameter to obtain a low band signal; calculating a voiced degree factor according to the low frequency encoding parameter, and predicting a high band excitation signal according to the low frequency encoding parameter, where the voiced degree factor is used to indicate a degree of a voiced characteristic presented by a high band signal; weighting the high band excitation signal and random noise using the voiced degree factor, so as to obtain a synthesized excitation signal; obtaining the high band signal based on the synthesized excitation signal and the high frequency encoding parameter; and combining the low band signal and the high band signal to obtain a final decoded signal.

With reference to the second aspect, in an implementation manner of the second aspect, the weighting the high band excitation signal and random noise using the voiced degree factor, so as to obtain a synthesized excitation signal may include performing, on the random noise using a pre-emphasis factor, a pre-emphasis operation for enhancing a high frequency part of the random noise, so as to obtain pre-emphasis noise; weighting the high band excitation signal and the pre-emphasis noise using the voiced degree factor, so as to generate a pre-emphasis excitation signal; and performing, on the pre-emphasis excitation signal using a de-emphasis factor, a de-emphasis operation for lowering a high frequency part of the pre-emphasis excitation signal, so as to obtain the synthesized excitation signal.

With reference to the second aspect and the foregoing implementation manner, in another implementation manner of the second aspect, the de-emphasis factor may be determined based on the pre-emphasis factor and a proportion of the pre-emphasis noise in the pre-emphasis excitation signal.

With reference to the second aspect and the foregoing implementation manners, in another implementation manner of the second aspect, the low frequency encoding parameter may include a pitch period, and the weighting the predicted high band excitation signal and random noise using the voiced degree factor, so as to obtain a synthesized excitation signal may include modifying the voiced degree factor using the pitch period; and weighting the high band excitation signal and the random noise using a modified voiced degree factor, so as to obtain the synthesized excitation signal.

With reference to the second aspect and the foregoing implementation manners, in another implementation manner of the second aspect, the low frequency encoding parameter may include an algebraic codebook, an algebraic codebook gain, an adaptive codebook, an adaptive codebook gain, and a pitch period, and the predicting a high band excitation signal according to the low frequency encoding parameter may include modifying the voiced degree factor using the pitch period; weighting the algebraic codebook and the random noise using a modified voiced degree factor, so as to obtain a weighting result, and adding a product of the weighting result and the algebraic codebook gain and a product of the adaptive codebook and the adaptive codebook gain, so as to predict the high band excitation signal.

With reference to the second aspect and the foregoing implementation manners, in another implementation manner of the second aspect, the modifying the voiced degree factor using the pitch period is performed according to the following formula:

$$\text{voice_fac_A} = \text{voice_fac} * \gamma$$

$$\gamma = \begin{cases} -a1 * T0 + b1 & T0 \le \text{threshold_min} \\ a2 * T0 + b2 & \text{threshold_min} \le T0 \le \text{threshold_max} \\ 1 & T0 \ge \text{threshold_max} \end{cases}$$

where voice_fac is the voiced degree factor, T0 is the pitch period, a1, a2, and b1>0, b2≥0, threshold_min and threshold_max are respectively a preset minimum value and a preset maximum value of the pitch period, and voice_fac_A is the modified voiced degree factor.

According to a third aspect, an audio signal encoding apparatus is provided, including a division unit configured to divide a to-be-encoded time domain signal into a low band signal and a high band signal; a low frequency encoding unit configured to encode the low band signal to obtain a low frequency encoding parameter; a calculation unit configured to calculate a voiced degree factor according to the low frequency encoding parameter, where the voiced degree factor is used to indicate a degree of a voiced characteristic presented by the high band signal; a prediction unit configured to predict a high band excitation signal according to the low frequency encoding parameter; a synthesizing unit configured to weight the high band excitation signal and random noise using the voiced degree factor, so as to obtain a synthesized excitation signal; and a high frequency encoding unit configured to obtain a high frequency encoding parameter based on the synthesized excitation signal and the high band signal.

With reference to the third aspect, in an implementation manner of the third aspect, the synthesizing unit may include a pre-emphasis component configured to perform, on the random noise using a pre-emphasis factor, a pre-emphasis operation for enhancing a high frequency part of the random noise, so as to obtain pre-emphasis noise; a weighting component configured to weight the high band excitation signal and the pre-emphasis noise using the voiced degree factor, so as to generate a pre-emphasis excitation signal; and a de-emphasis component configured to perform, on the pre-emphasis excitation signal using a de-emphasis factor, a de-emphasis operation for lowering a high frequency part of the pre-emphasis excitation signal, so as to obtain the synthesized excitation signal.

With reference to the third aspect and the foregoing implementation manner, in another implementation manner of the third aspect, the de-emphasis factor is determined based on the pre-emphasis factor and a proportion of the pre-emphasis noise in the pre-emphasis excitation signal.

With reference to the third aspect and the foregoing implementation manners, in another implementation manner of the third aspect, the low frequency encoding parameter may include a pitch period, and the synthesizing unit may include a first modification component configured to modify the voiced degree factor using the pitch period; and a weighting component configured to weight the high band excitation signal and the random noise using a modified voiced degree factor, so as to obtain the synthesized excitation signal.

With reference to the third aspect and the foregoing implementation manners, in another implementation manner of the third aspect, the low frequency encoding parameter may include an algebraic codebook, an algebraic codebook gain, an adaptive codebook, an adaptive codebook gain, and a pitch period, and the prediction unit may include a second modification component configured to modify the voiced degree factor using the pitch period; and a prediction component configured to weight the algebraic codebook and the random noise using a modified voiced degree factor, so as to obtain a weighting result, and add a product of the weighting result and the algebraic codebook gain and a product of the adaptive codebook and the adaptive codebook gain, so as to predict the high band excitation signal.

With reference to the third aspect and the foregoing implementation manners, in another implementation manner of the third aspect, at least one of the first modification component and the second modification component may modify the voiced degree factor according to the following formula:

$$\text{voice_fac_A} = \text{voice_fac} * \gamma$$

$$\gamma = \begin{cases} -a1 * T0 + b1 & T0 \le \text{threshold_min} \\ a2 * T0 + b2 & \text{threshold_min} \le T0 \le \text{threshold_max} \\ 1 & T0 \ge \text{threshold_max} \end{cases}$$

where voice_fac is the voiced degree factor, T0 is the pitch period, a1, a2, and b1>0, b2≥0, threshold_min and threshold_max are respectively a preset minimum value and a preset maximum value of the pitch period, and voice_fac_A is the modified voiced degree factor.

With reference to the third aspect and the foregoing implementation manners, in another implementation manner of the third aspect, the audio signal encoding apparatus may further include a bitstream generating unit configured to generate a coded bitstream according to the low frequency encoding parameter and the high frequency encoding parameter, so as to send the coded bitstream to a decoder side.

According to a fourth aspect, an audio signal decoding apparatus is provided, including a distinguishing unit configured to distinguish a low frequency encoding parameter and a high frequency encoding parameter in encoded information; a low frequency decoding unit configured to decode the low frequency encoding parameter to obtain a low band signal; a calculation unit configured to calculate a voiced degree factor according to the low frequency encoding parameter, where the voiced degree factor is used to indicate a degree of a voiced characteristic presented by a high band signal; a prediction unit configured to predict a high band excitation signal according to the low frequency encoding parameter; a synthesizing unit configured to weight the high band excitation signal and random noise using the voiced degree factor, so as to obtain a synthesized excitation signal; a high frequency decoding unit configured to obtain the high band signal based on the synthesized excitation signal and the high frequency encoding parameter; and a combining unit configured to combine the low band signal and the high band signal to obtain a final decoded signal.

With reference to the fourth aspect, in an implementation manner of the fourth aspect, the synthesizing unit may include a pre-emphasis component configured to perform, on the random noise using a pre-emphasis factor, a pre-emphasis operation for enhancing a high frequency part of the random noise, so as to obtain pre-emphasis noise; a weighting component configured to weight the high band excitation signal and the pre-emphasis noise using the voiced degree factor, so as to generate a pre-emphasis excitation signal; and a de-emphasis component configured to perform, on the pre-emphasis excitation signal using a de-emphasis factor, a de-emphasis operation for lowering a high frequency part of the pre-emphasis excitation signal, so as to obtain the synthesized excitation signal.

With reference to the fourth aspect and the foregoing implementation manner, in another implementation manner of the fourth aspect, the de-emphasis factor is determined based on the pre-emphasis factor and a proportion of the pre-emphasis noise in the pre-emphasis excitation signal.

With reference to the fourth aspect and the foregoing implementation manners, in another implementation manner of the fourth aspect, the low frequency encoding parameter may include a pitch period, and the synthesizing unit may include a first modification component configured to modify the voiced degree factor using the pitch period; and a weighting component configured to weight the high band excitation signal and the random noise using a modified voiced degree factor, so as to obtain the synthesized excitation signal.

With reference to the fourth aspect and the foregoing implementation manners, in another implementation manner of the fourth aspect, the low frequency encoding parameter may include an algebraic codebook, an algebraic codebook gain, an adaptive codebook, an adaptive codebook gain, and a pitch period, and the prediction unit may include a second modification component configured to modify the voiced degree factor using the pitch period; and a prediction component configured to weight the algebraic codebook and the random noise using a modified voiced degree factor, so as to obtain a weighting result, and add a product of the weighting result and the algebraic codebook gain and a product of the adaptive codebook and the adaptive codebook gain, so as to predict the high band excitation signal.

With reference to the fourth aspect and the foregoing implementation manners, in another implementation manner of the fourth aspect, at least one of the first modification component and the second modification component may modify the voiced degree factor according to the following formula:

$$\text{voice_fac_A} = \text{voice_fac} * \gamma$$

$$\gamma = \begin{cases} -a1 * T0 + b1 & T0 \le \text{threshold_min} \\ a2 * T0 + b2 & \text{threshold_min} \le T0 \le \text{threshold_max} \\ 1 & T0 \ge \text{threshold_max} \end{cases}$$

where voice_fac is the voiced degree factor, T0 is the pitch period, a1, a2, and b1>0, b2≥0, threshold_min and threshold_max are respectively a preset minimum value and a preset maximum value of the pitch period, and voice_fac_A is the modified voiced degree factor.

According to a fifth aspect, a transmitter is provided, including the audio signal encoding apparatus according to the third aspect; a transmit unit configured to perform bit allocation for a high frequency encoding parameter and a low frequency encoding parameter that are generated by the audio signal encoding apparatus, so as to generate a bitstream and transmit the bitstream.

According to a sixth aspect, a receiver is provided, including a receive unit configured to receive a bitstream and extract encoded information from the bitstream; and the audio signal decoding apparatus according to the fourth aspect.

According to a seventh aspect, a communications system is provided, including the transmitter according to the fifth aspect or the receiver according to the sixth aspect.

In the foregoing technical solutions in the embodiments of the present invention, during encoding and decoding, a high band excitation signal and random noise are weighted using a voiced degree factor, so as to obtain a synthesized excitation signal, and a characteristic of a high band signal may be more accurately presented based on a voiced signal, thereby improving an encoding and decoding effect.

BRIEF DESCRIPTION OF DRAWINGS

To describe the technical solutions in the embodiments of the present invention more clearly, the following briefly introduces the accompanying drawings required for describing the embodiments or the prior art. The accompanying drawings in the following description show merely some embodiments of the present invention, and a person of ordinary skill in the art may still derive other drawings from these accompanying drawings without creative efforts.

DESCRIPTION OF EMBODIMENTS

The following clearly describes the technical solutions in the embodiments of the present invention with reference to the accompanying drawings in the embodiments of the present invention. The described embodiments are some but not all of the embodiments of the present invention. All other embodiments obtained by a person of ordinary skill in the art based on the embodiments of the present invention without creative efforts shall fall within the protection scope of the present invention.

In the field of digital signal processing, audio codecs are widely applied to various electronic devices, for example, a mobile phone, a wireless apparatus, a personal digital assistant (PDA), a handheld or portable computer, a global positioning system (GPS) receiver/navigator, a camera, an audio/video player, a camcorder, a video recorder, and a monitoring device. Generally, this type of electronic device includes an audio encoder or an audio decoder to implement encoding and decoding of an audio signal, where the audio encoder or the audio decoder may be directly implemented by a digital circuit or a chip, for example, a digital signal processor (DSP), or be implemented using software code to drive a processor to execute a process in the software code.

In addition, the audio codec and an audio encoding and decoding method may also be applied to various communications systems, such as Global System for Mobile Communications (GSM), a Code Division Multiple Access (CDMA) system, Wideband Code Division Multiple Access (WCDMA), a general packet radio service (GPRS), and Long Term Evolution (LIE).

Figure 1:
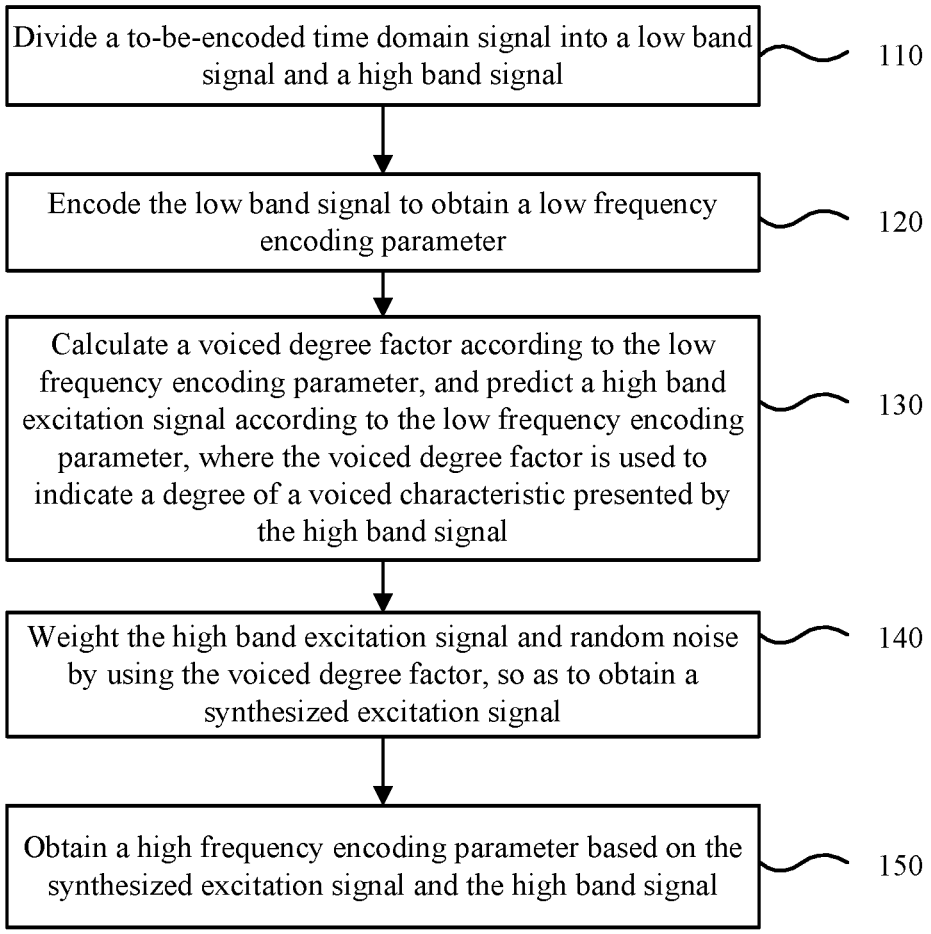
FIG. 1 is a schematic flowchart of an audio signal encoding method according to an embodiment of the present invention.

FIG. 1 is a schematic flowchart of an audio signal encoding method 100 according to an embodiment of the present invention. The audio signal encoding method includes dividing a to-be-encoded time domain signal into a low band signal and a high band signal (step 110); encoding the low band signal to obtain a low frequency encoding parameter (step 120); calculating a voiced degree factor according to the low frequency encoding parameter, and predicting a high band excitation signal according to the low frequency encoding parameter, where the voiced degree factor is used to indicate a degree of a voiced characteristic presented by the high band signal (step 130); weighting the high band excitation signal and random noise using the voiced degree factor, so as to obtain a synthesized excitation signal (step 140); and obtaining a high frequency encoding parameter based on the synthesized excitation signal and the high band signal (step 150).

In step 110, the to-be-encoded time domain signal is divided into the low band signal and the high band signal. The division is to divide the time domain signal into two signals for processing, so that the low band signal and the high band signal can be separately processed. The division may be implemented using any conventional or future division technology. The meaning of the low frequency herein is relative to the meaning of the high frequency. For example, a frequency threshold may be set, where a frequency lower than the frequency threshold is a low frequency, and a frequency higher than the frequency threshold is a high frequency. In practice, the frequency threshold may be set according to a requirement, and a low band signal component and a high band signal component in a signal may also be distinguished using another manner, so as to implement division.

In step 120, the low band signal is encoded to obtain the low frequency encoding parameter. By the encoding, the low band signal is processed so as to obtain the low frequency encoding parameter, so that a decoder side restores the low band signal according to the low frequency encoding parameter. The low frequency encoding parameter is a parameter required by the decoder side to restore the low band signal. As an example, encoding may be performed using an encoder using an algebraic code excited linear prediction (ACELP) algorithm (or an ACELP encoder), and a low frequency encoding parameter obtained in this case may include, for example, an algebraic codebook, an algebraic codebook gain, an adaptive codebook, an adaptive codebook gain, and a pitch period, and may also include another parameter. The low frequency encoding parameter may be transferred to the decoder side to restore the low band signal. In addition, when the algebraic codebook and the adaptive codebook are transferred from an encoder side to the decoder side, only an algebraic codebook index and an adaptive codebook index may be transferred, and the decoder side obtains a corresponding algebraic codebook and adaptive codebook according to the algebraic codebook index and the adaptive codebook index, so as to implement restoration.

In practice, the low band signal may be encoded using a proper encoding technology according to a requirement. When an encoding technology changes, composition of the low frequency encoding parameter may also change. In this embodiment of the present invention, an encoding technology using the ACELP algorithm is used as an example for description.

In step 130, the voiced degree factor is calculated according to the low frequency encoding parameter, and the high band excitation signal is predicted according to the low frequency encoding parameter, where the voiced degree factor is used to indicate the degree of the voiced characteristic presented by the high band signal. Therefore, step 130 is used to obtain the voiced degree factor and the high band excitation signal from the low frequency encoding parameter, where the voiced degree factor and the high band excitation signal are used to indicate different characteristics of the high band signal, that is, a high frequency characteristic of an input signal is obtained in step 130, so that the high frequency characteristic is used for encoding of the high band signal. The encoding technology using the ACELP algorithm is used as an example below, so as to describe calculation of both the voiced degree factor and the high band excitation signal.

The voiced degree factor voice_fac may be calculated according to the following formula (1):

$$\text{voice_fac}=a*\text{voice_factor}^2 b*\text{voice_factor}+c \qquad \text{formula (1)}$$

where, $\text{voice_factor}=(\text{ener}_{adp}-\text{ener}_{cb})/(\text{ener}_{adp}+\text{ener}_{cb})$.

where $\text{ener}_{adp}$ is energy of the adaptive codebook, $\text{ener}_{cb}$ is energy of the algebraic codebook, and a, b, and c are preset values. The parameters a, b, and c are set according to the following rules: a value of voice_fac is between 0 and 1; voice_factor of a liner change changes to voice_fac of a non-linear change, so that a characteristic of the voiced degree factor voice_fac is better presented.

In addition, to enable the voiced degree factor voice_fac to better present a characteristic of the high band signal, the voiced degree factor may further be modified using the pitch period in the low frequency encoding parameter. As an example, the voiced degree factor voice_fac in formula (1) may further be modified according to the following formula (2):

$$\text{voice_fac_A} = \text{voice_fac}*\gamma \qquad \text{formula (2)}$$

$$\gamma = \begin{cases} -a1*T0+b1 & T0 \le \text{threshold_min} \\ a2*T0+b2 & \text{threshold_min} \le T0 \le \text{threshold_max} \\ 1 & T0 \ge \text{threshold_max} \end{cases}$$

where voice_fac is the voiced degree factor, T0 is the pitch period, a1, a2, and b1>0, b2≥0, threshold_min and threshold_max are respectively a preset minimum value and a preset maximum value of the pitch period, and voice_fac_A is a modified voiced degree factor.

As an example, values of all parameters in formula (2) may be as follows: a1=0.0126, b1=1.23, a2=0.0087, b2=0, threshold_min=57.75, and threshold_max=115.5. The parameter values are merely exemplary and another value may be set according to a requirement. Compared with an unmodified voiced degree factor, the modified voiced degree factor can more accurately indicate the degree of the voiced characteristic presented by the high band signal, thereby helping weaken a mechanical sound introduced after a voiced signal of a general period is extended.

The high band excitation signal Ex may be calculated according to the following formula (3) or formula (4):

$$Ex=(\text{Fix}CB+(1-\text{voice_fac})*\text{seed})*gc+AdpCB*ga \qquad \text{formula (3)}$$

$$Ex=(\text{voice_fac}*\text{Fix}CB+(1-\text{voice_fac})*\text{seed})*gc+AdpCB*ga \qquad \text{formula (4)}$$

where FixCB is the algebraic codebook, seed is the random noise, gc is the algebraic codebook gain, AdpCB is the adaptive codebook, and ga is the adaptive codebook gain. It may be learned that, in formula (3) or (4), the algebraic codebook FixCB and the random noise seed are weighted using the voiced degree factor, so as to obtain a weighting result; and a product of the weighting result and the algebraic codebook gain gc, and a product of the adaptive codebook AdpCB and the adaptive codebook gain ga are added, so as to obtain the high band excitation signal Ex. Alternatively, in formula (3) or (4), the voiced degree factor voice_fac may be replaced with the modified voiced degree factor voice_fac_A in formula (2), so as to more accurately indicate the degree of the voiced characteristic presented by the high band signal, that is, a high band signal in a voice signal is more realistically indicated, thereby improving an encoding effect.

It should be noted that, the foregoing manners of calculating the voiced degree factor and the high band excitation signal are merely exemplary, and are not intended to limit this embodiment of the present invention. In another encoding technology without using the ACELP algorithm, the voiced degree factor and the high band excitation signal may also be calculated using another manner.

In step 140, the high band excitation signal and the random noise are weighted using the voiced degree factor, so as to obtain the synthesized excitation signal. As described above, in the prior art, for the voiced signal of a general period, because periodicity of the high band excitation signal predicted according to the low frequency encoding parameter is extremely strong, there is a strong mechanical sound when a restored audio signal sounds. By step 140, the high band excitation signal predicted according to the low band signal and the noise are weighted using the voiced degree factor, which can weaken periodicity of the high band excitation signal predicted according to the low frequency encoding parameter, thereby weakening a mechanical sound in the restored audio signal.

The weighting may be implemented using a proper weight according to a requirement. As an example, the synthesized excitation signal SEx may be obtained according to the following formula (5):

$$SEx = Ex * \sqrt{\sqrt{\text{voice_fac}}} + \text{seed}\sqrt{pow1 * (1 - \sqrt{\text{voice_fac}})/pow2} \quad \text{formula (5)}$$

where Ex is the high band excitation signal, seed is the random noise, voice_fac is the voiced degree factor, pow1 is energy of the high band excitation signal, and pow2 is energy of the random noise. Alternatively, in formula (5), the voiced degree factor voice_fac may be replaced with the modified voiced degree factor voice_fac_A in formula (2), so as to more accurately indicate the high band signal in the voice signal, thereby improving an encoding effect.

In a case that in formula (2), a1=0.0126, b1=1.23, a2=0.0087, b2=0, threshold_min=57.75, and threshold_max=115.5, if the synthesized excitation signal SEx is obtained according to formula (5), a high band excitation signal of which a pitch period T0 is greater than threshold_max and less than threshold_min has a greater weight, and another high band excitation signal has a less weight. It should be noted that, according to a requirement, the synthesized excitation signal may also be calculated using another manner in addition to formula (5).

In addition, when the high band excitation signal and the random noise are weighted using the voiced degree factor, pre-emphasis may also be performed on the random noise in advance, and de-emphasis may be performed on the random noise after weighting. Step 140 may include performing, on the random noise using a pre-emphasis factor, a pre-emphasis operation for enhancing a high frequency part of the random noise, so as to obtain pre-emphasis noise; weighting the high band excitation signal and the pre-emphasis noise using the voiced degree factor, so as to generate a pre-emphasis excitation signal; and performing, on the pre-emphasis excitation signal using a de-emphasis factor, a de-emphasis operation for lowering a high frequency part of the pre-emphasis excitation signal, so as to obtain the synthesized excitation signal. For a general voiced sound, a noise component usually becomes stronger from a low frequency to a high frequency. Based on this, the pre-emphasis operation is performed on the random noise, so as to accurately indicate a noise signal characteristic of a voiced sound, that is, a high frequency part of noise is improved and a low frequency part of the noise is lowered. As an example of the pre-emphasis operation, a pre-emphasis operation may be performed on the random noise seed(n) using the following formula (6):

$$\text{seed}(n) = \text{seed}(n) - \alpha\,\text{seed}(n-1) \quad \text{formula (6)}$$

where n=1, 2, . . . N, and α is the pre-emphasis factor and 0<α<1. The pre-emphasis factor may be properly set based on a characteristic of the random noise, so as to accurately indicate the noise signal characteristic of the voiced sound. In a case that the pre-emphasis operation is performed using formula (6), a de-emphasis operation may be performed on the pre-emphasis excitation signal S(i) using the following formula (7):

$$S(n) = S(n) + \beta S(n-1) \quad \text{formula (7)}$$

where n=1, 2, . . . N, and β is a preset de-emphasis factor.

It should be noted that, the pre-emphasis operation shown in the foregoing formula (6) is merely exemplary, and in practice, pre-emphasis may be performed using another manner. In addition, when a used pre-emphasis operation changes, the de-emphasis operation also needs to correspondingly change. The de-emphasis factor β may be determined based on the pre-emphasis factor α and a proportion of the pre-emphasis noise in the pre-emphasis excitation signal. As an example, when the high band excitation signal and the pre-emphasis noise are weighted according to formula (5) using the voiced degree factor (the pre-emphasis excitation signal is obtained in this case, and the synthesized excitation signal is obtained only after de-emphasis is performed on the pre-emphasis excitation signal), the de-emphasis factor β may be determined according to the following formula (8) or formula (9):

$$\beta = \alpha * \text{weight1}/(\text{weight1} + \text{weight2}) \quad \text{formula (8)}$$
$$\text{where, weight1} = 1 - \sqrt{1 - \text{voice_fac}},$$
$$\text{weight2} = \sqrt{\text{voice_fac}}$$

$$\beta = \alpha * \text{weight1}/(\text{weight1} + \text{weight2}) \quad \text{formula (9)}$$
$$\text{where, weight1} = \sqrt{(1 - \sqrt{1 - \text{voice_fac}})},$$
$$\text{weight2} = \sqrt{\sqrt{\text{voice_fac}}}$$

In step 150, the high frequency encoding parameter is obtained based on the synthesized excitation signal and the high band signal. As an example, the high frequency encoding parameter includes a high frequency gain adjustment parameter and a high frequency LPC coefficient. The high frequency LPC coefficient may be obtained by performing an LPC analysis on a high band signal in an original signal; a predicted high band signal is obtained after the synthesized excitation signal is filtered using a synthesis filter determined according to the LPC coefficient; the high frequency gain adjustment parameter is obtained by comparing the predicted high band signal with the high band signal in the original signal, where the high frequency gain adjustment parameter and the LPC coefficient are transferred to the decoder side to restore the high band signal. In addition, the high frequency encoding parameter may also be obtained using various conventional or future technologies, and a specific manner of obtaining the high frequency encoding parameter based on the synthesized excitation signal and the high band signal does not constitute a limitation to the present invention. After the low frequency encoding parameter and the high frequency encoding parameter are obtained, encoding of a signal is implemented, so that the signal can be transferred to the decoder side for restoration.

After the low frequency encoding parameter and the high frequency encoding parameter are obtained, the audio signal encoding method 100 may further include generating a coded bitstream according to the low frequency encoding parameter and the high frequency encoding parameter, so as to send the coded bitstream to the decoder side.

In the foregoing audio signal encoding method in this embodiment of the present invention, a high band excitation signal and random noise are weighted using a voiced degree factor, so as to obtain a synthesized excitation signal, and a characteristic of a high band signal may be more accurately presented based on a voiced signal, thereby improving an encoding effect.

Figure 2:
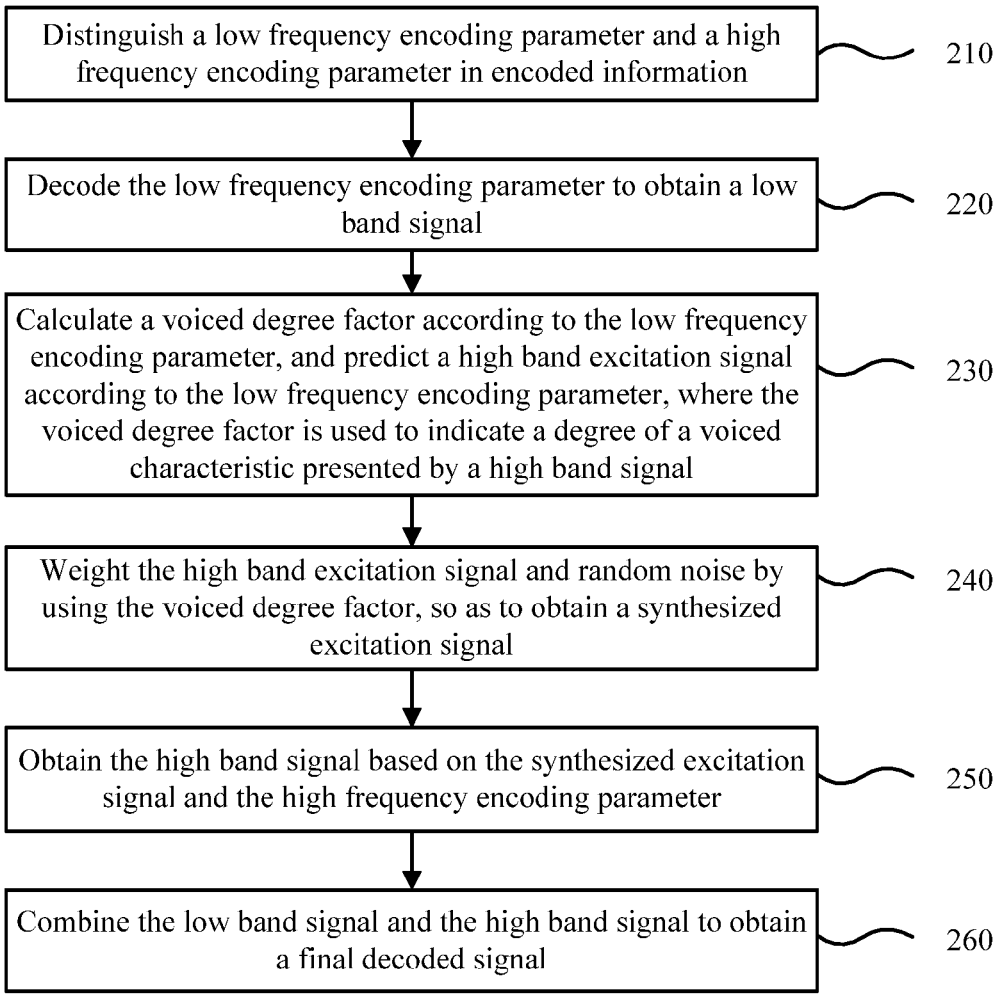
FIG. 2 is a schematic flowchart of an audio signal decoding method according to an embodiment of the present invention.

FIG. 2 is a schematic flowchart of an audio signal decoding method 200 according to an embodiment of the present invention. The audio signal decoding method includes distinguishing a low frequency encoding parameter and a high frequency encoding parameter in encoded information (step 210); decoding the low frequency encoding parameter to obtain a low band signal (step 220); calculating a voiced degree factor according to the low frequency encoding parameter, and predicting a high band excitation signal according to the low frequency encoding parameter, where the voiced degree factor is used to indicate a degree of a voiced characteristic presented by a high band signal (step 230); weighting the high band excitation signal and random noise using the voiced degree factor, so as to obtain a synthesized excitation signal (step 240); obtaining the high band signal based on the synthesized excitation signal and the high frequency encoding parameter (step 250); and combining the low band signal and the high band signal to obtain a final decoded signal (step 260).

In step 210, the low frequency encoding parameter and the high frequency encoding parameter are distinguished in the encoded information. The low frequency encoding parameter and the high frequency encoding parameter are parameters that are transferred from an encoder side and used to restore the low band signal and the high band signal. The low frequency encoding parameter may include, for example, an algebraic codebook, an algebraic codebook gain, an adaptive codebook, an adaptive codebook gain, a pitch period, and another parameter, and the high frequency encoding parameter may include, for example, an LPC coefficient, a high frequency gain adjustment parameter, and another parameter. In addition, according to a different encoding technology, the low frequency encoding parameter and the high frequency encoding parameter may alternatively include another parameter.

In step 220, the low frequency encoding parameter is decoded to obtain the low band signal. A specific decoding mode is corresponding to an encoding manner of the encoder side. As an example, when encoding is performed on the encoder side using an ACELP encoder using an ACELP algorithm, an ACELP decoder is used in step 220 to obtain the low band signal.

In step 230, the voiced degree factor is calculated according to the low frequency encoding parameter, and the high band excitation signal is predicted according to the low frequency encoding parameter, where the voiced degree factor is used to indicate the degree of the voiced characteristic presented by the high band signal. Step 230 is used to obtain a high frequency characteristic of an encoded signal according to the low frequency encoding parameter, so that the high frequency characteristic is used for decoding (or restoration) of the high band signal. A decoding technology that is corresponding to an encoding technology using the ACELP algorithm is used as an example for description in the following.

The voiced degree factor voice_fac may be calculated according to the foregoing formula (1), and to better present a characteristic of the high band signal, the voiced degree factor voice_fac may be modified as shown in the foregoing formula (2) using the pitch period in the low frequency encoding parameter, and a modified voiced degree factor voice_fac_A may be obtained. Compared with an unmodified voiced degree factor voice_fac, the modified voiced degree factor voice_fac_A can more accurately indicate the degree of the voiced characteristic presented by the high band signal, thereby helping to weaken a mechanical sound introduced after a voiced signal of a general period is extended.

The high band excitation signal Ex may be calculated according to the foregoing formula (3) or formula (4), that is, the algebraic codebook and the random noise are weighted using the voiced degree factor, so as to obtain a weighting result; and a product of the weighting result and the algebraic codebook gain, and a product of the adaptive codebook and the adaptive codebook gain are added, so as to obtain the high band excitation signal Ex. Similarly, the voiced degree factor voice_fac may be replaced with the modified voiced degree factor voice_fac_A in formula (2), so as to further improve a decoding effect.

The foregoing manners of calculating the voiced degree factor and the high band excitation signal are merely exemplary, and are not used to limit this embodiment of the present invention. In another encoding technology without using the ACELP algorithm, the voiced degree factor and the high band excitation signal may also be calculated using another manner.

For description of step 230, refer to the foregoing description of step 130 with reference to FIG. 1.

In step 240, the high band excitation signal and the random noise are weighted using the voiced degree factor, so as to obtain the synthesized excitation signal. By step 240, the high band excitation signal predicted according to the low frequency encoding parameter and the noise are weighted using the voiced degree factor, which can weaken periodicity of the high band excitation signal predicted according to the low frequency encoding parameter, thereby weakening a mechanical sound in the restored audio signal.

As an example, in step 240, the synthesized excitation signal SEex may be obtained according to the foregoing formula (5), and the voiced degree factor voice_fac in formula (5) may be replaced with the modified voiced degree factor voice_fac_A in formula (2), so as to more accurately indicate a high band signal in a voice signal, thereby improving an encoding effect. According to a requirement, the synthesized excitation signal may also be calculated using another manner.

In addition, when the high band excitation signal and the random noise are weighted using the voiced degree factor voice_fac (or the modified voiced degree factor voice_fac_A), pre-emphasis may also be performed on the random noise in advance, and de-emphasis may be performed on the random noise after weighting. Step 240 may include performing, on the random noise using a pre-emphasis factor $\alpha$, a pre-emphasis operation (for example, the pre-emphasis operation is implemented using formula (6)) for enhancing a high frequency part of the random noise, so as to obtain pre-emphasis noise; weighting the high band excitation signal and the pre-emphasis noise using the voiced degree factor, so as to generate a pre-emphasis excitation signal;

and performing, on the pre-emphasis excitation signal using a de-emphasis factor β, a de-emphasis operation (for example, the de-emphasis operation is implemented using formula (7)) for lowering a high frequency part of the pre-emphasis excitation signal, so as to obtain the synthesized excitation signal. The pre-emphasis factor α may be preset according to a requirement, so as to accurately indicate a noise signal characteristic of a voiced sound, that is, a high frequency part of noise has a strong signal and a low frequency part of the noise has a weak signal. In addition, noise of another type may also be used, and in this case, the pre-emphasis factor α needs to correspondingly change, so as to indicate a noise characteristic of a general voiced sound. The de-emphasis factor β may be determined based on the pre-emphasis factor α and a proportion of the pre-emphasis noise in the pre-emphasis excitation signal. As an example, the de-emphasis factor β may be determined according to the foregoing formula (8) or formula (9).

For description of step 240, refer to the foregoing description of step 140 with reference to FIG. 1.

In step 250, the high band signal is obtained based on the synthesized excitation signal and the high frequency encoding parameter. Step 250 is implemented in an inverse process of obtaining the high frequency encoding parameter based on the synthesized excitation signal and the high band signal on the encoder side. As an example, the high frequency encoding parameter includes a high frequency gain adjustment parameter and a high frequency LPC coefficient; a synthesis filter may be generated using the LPC coefficient in the high frequency encoding parameter; the predicted high band signal is restored after the synthesized excitation signal obtained in step 240 is filtered by the synthesis filter; and a final high band signal is obtained after the predicted high band signal is adjusted using the high frequency gain adjustment parameter in the high frequency encoding parameter. In addition, step 240 may also be implemented using various conventional or future technologies, and a specific manner of obtaining the high band signal based on the synthesized excitation signal and the high frequency encoding parameter does not constitute a limitation to the present invention.

In step 260, the low band signal and the high band signal are combined to obtain the final decoded signal. This combining manner is corresponding to a division manner in step 110 in FIG. 1, so that decoding is implemented to obtain a final output signal.

In the foregoing audio signal decoding method in this embodiment of the present invention, a high band excitation signal and random noise are weighted using a voiced degree factor, so as to obtain a synthesized excitation signal, and a characteristic of a high band signal may be more accurately presented based on a voiced signal, thereby improving a decoding effect.

Figure 3:
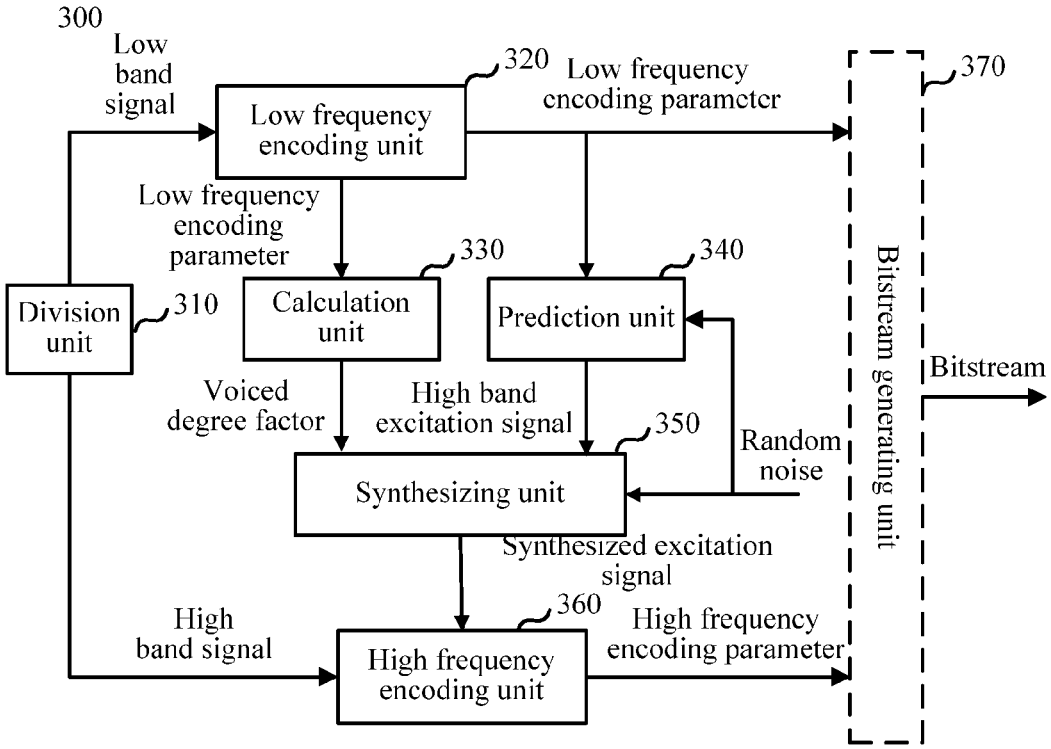
FIG. 3 is a schematic block diagram of an audio signal encoding apparatus according to an embodiment of the present invention.

FIG. 3 is a schematic block diagram of an audio signal encoding apparatus 300 according to an embodiment of the present invention. The audio signal encoding apparatus 300 includes a division unit 310 configured to divide a to-be-encoded time domain signal into a low band signal and a high band signal; a low frequency encoding unit 320 configured to encode the low band signal to obtain a low frequency encoding parameter; a calculation unit 330 configured to calculate a voiced degree factor according to the low frequency encoding parameter, where the voiced degree factor is used to indicate a degree of a voiced characteristic presented by the high band signal; a prediction unit 340 configured to predict a high band excitation signal according to the low frequency encoding parameter; a synthesizing unit 350 configured to weight the high band excitation signal and random noise using the voiced degree factor, so as to obtain a synthesized excitation signal; and a high frequency encoding unit 360 configured to obtain a high frequency encoding parameter based on the synthesized excitation signal and the high band signal.

After receiving an input time domain signal, the division unit 310 may implement the division using any conventional or future division technology. The meaning of the low frequency herein is relative to the meaning of the high frequency. For example, a frequency threshold may be set, where a frequency lower than the frequency threshold is a low frequency, and a frequency higher than the frequency threshold is a high frequency. In practice, the frequency threshold may be set according to a requirement, and a low band signal component and a high band signal component in a signal may also be distinguished using another manner, so as to implement division.

The low frequency encoding unit 320 may perform encoding using, for example, an ACELP encoder using an ACELP algorithm, and a low frequency encoding parameter obtained in this case may include, for example, an algebraic codebook, an algebraic codebook gain, an adaptive codebook, an adaptive codebook gain, and a pitch period, and may also include another parameter. In practice, the low band signal may be encoded using a proper encoding technology according to a requirement; when an encoding technology changes, composition of the low frequency encoding parameter may also change. The obtained low frequency encoding parameter is a parameter that is required to restore the low band signal and is transferred to a decoder to restore the low band signal.

Figure 4:
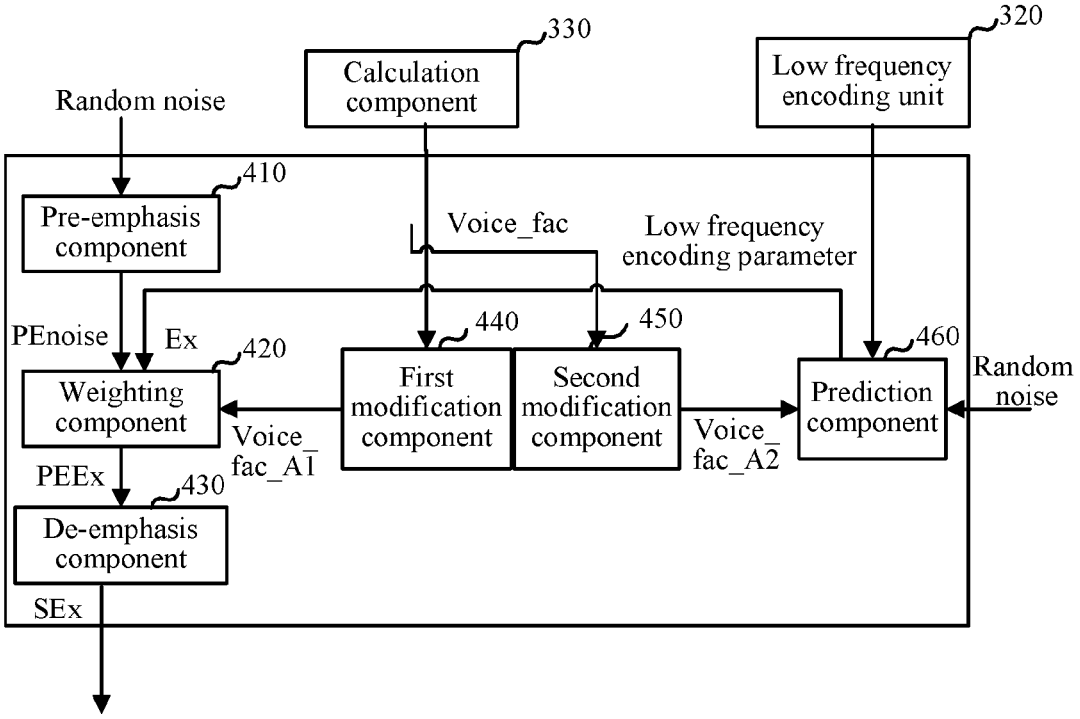
FIG. 4 is a schematic block diagram of a prediction unit and a synthesizing unit in an audio signal encoding apparatus according to an embodiment of the present invention.

The calculation unit 330 calculates, according to the low frequency encoding parameter, a parameter used to indicate a high frequency characteristic of an encoded signal, that is, the voiced degree factor. The calculation unit 330 calculates the voiced degree factor voice_fac according to the low frequency encoding parameter obtained using the low frequency encoding unit 320; and for example, may calculate the voiced degree factor voice_fac according to the foregoing formula (1). Then, the voiced degree factor is used to obtain the synthesized excitation signal, where the synthesized excitation signal is transferred to the high frequency encoding unit 360 for encoding of the high band signal. FIG. 4 is a schematic block diagram of a prediction unit 340 and a synthesizing unit 350 in an audio signal encoding apparatus according to an embodiment of the present invention.

The prediction unit 340 may merely include a prediction component 460 in FIG. 4, or may include both a second modification component 450 and the prediction component 460 in FIG. 4.

To better present a characteristic of a high band signal, so as to weaken a mechanical sound introduced after a voiced signal of a general period is extended, for example, the second modification component 450 modifies the voiced degree factor voice_fac using the pitch period T0 in the low frequency encoding parameter according to the foregoing formula (2), and obtains a modified voiced degree factor voice_fac_A2.

For example, the prediction component 460 calculates the high band excitation signal Ex according to the foregoing formula (3) or formula (4), that is, the prediction component 460 weights the algebraic codebook in the low frequency encoding parameter and the random noise using the modified voiced degree factor voice_fac_A2, so as to obtain a weighting result, and adds a product of the weighting result and the algebraic codebook gain and a product of the adaptive codebook and the adaptive codebook gain, so as to obtain the high band excitation signal Ex. The prediction component 460 may also weight the algebraic codebook in the low frequency encoding parameter and the random noise using the voiced degree factor voice_fac calculated using the calculation unit 330, so as to obtain a weighting result, and in this case, the second modification component 450 may be omitted. It should be noted that, the prediction component 460 may also calculate the high band excitation signal Ex using another manner.

As an example, the synthesizing unit 350 may include a pre-emphasis component 410, a weighting component 420, and a de-emphasis component 430 in FIG. 4; may include a first modification component 440 and the weighting component 420 in FIG. 4; or may further include the pre-emphasis component 410, the weighting component 420, the de-emphasis component 430, and the first modification component 440 in FIG. 4.

For example, using formula (6), the pre-emphasis component 410 performs, on the random noise using a pre-emphasis factor $\alpha$, a pre-emphasis operation for enhancing a high frequency part of the random noise, so as to obtain pre-emphasis noise PEnoise. The random noise may be the same as random noise input to the prediction component 460. The pre-emphasis factor $\alpha$ may be preset according to a requirement, so as to accurately indicate a noise signal characteristic of a voiced sound, that is, a high frequency part of noise has a strong signal and a low frequency part of the noise has a weak signal. When noise of another type is used, the pre-emphasis factor $\alpha$ needs to correspondingly change, so as to indicate a noise characteristic of a general voiced sound.

The weighting component 420 is configured to weight the high band excitation signal Ex from the prediction component 460 and the pre-emphasis noise PEnoise from the pre-emphasis component 410 using the modified voiced degree factor voice_fac_A1, so as to generate a pre-emphasis excitation signal PEEx. As an example, the weighting component 420 may obtain the pre-emphasis excitation signal PEEx according to the foregoing formula (5) (the modified voiced degree factor voice_fac_A1 is used to replace the voiced degree factor voice_fac), and may also calculate the pre-emphasis excitation signal using another manner. The modified voiced degree factor voice_fac_A1 is generated using the first modification component 440, where the first modification component 440 modifies the voiced degree factor using the pitch period, so as to obtain the modified voiced degree factor voice_fac_A1. A modification operation performed by the first modification component 440 may be the same as a modification operation performed by the second modification component 450, and may also be different from the modification operation of the second modification component 450. That is, the first modification component 440 may modify the voiced degree factor voice_fac based on the pitch period using another formula in addition to the foregoing formula (2).

For example, using formula (7), the de-emphasis component 430 performs, on the pre-emphasis excitation signal PEEx from the weighting component 420 using a de-emphasis factor $\beta$, a de-emphasis operation for lowering a high frequency part of the pre-emphasis excitation signal PEEx, so as to obtain the synthesized excitation signal SEx. The de-emphasis factor $\beta$ may be determined based on the pre-emphasis factor $\alpha$ and a proportion of the pre-emphasis noise in the pre-emphasis excitation signal. As an example, the de-emphasis factor $\beta$ may be determined according to the foregoing formula (8) or formula (9).

As described above, to replace the modified voiced degree factor voice_fac_A1 or voice_fac_A2, the voiced degree factor voice_fac output by the calculation unit 330 may be provided for the weighting component 420 or the prediction component 460 or both. In addition, the pre-emphasis component 410 and the de-emphasis component 430 may also be deleted, and the weighting component 420 weights the high band excitation signal Ex and the random noise using the modified voiced degree factor (or the voiced degree factor voice_fac), so as to obtain the synthesized excitation signal.

For description of the prediction unit 340 or the synthesizing unit 350, refer to the foregoing description in 130 and 140 with reference to FIG. 1.

The high frequency encoding unit 360 obtains the high frequency encoding parameter based on the synthesized excitation signal SEx and the high band signal from the division unit 310. As an example, the high frequency encoding unit 360 obtains a high frequency LPC coefficient by performing an LPC analysis on the high band signal; obtains a predicted high band signal after the high band excitation signal is filtered using a synthesis filter determined according to the LPC coefficient; and obtains a high frequency gain adjustment parameter by comparing the predicted high band signal with the high band signal from the division unit 310, where the high frequency gain adjustment parameter and the LPC coefficient are components of the high frequency encoding parameter. In addition, the high frequency encoding unit 360 may also obtain the high frequency encoding parameter using various conventional or future technologies, and a specific manner of obtaining the high frequency encoding parameter based on the synthesized excitation signal and the high band signal does not constitute a limitation to the present invention. After the low frequency encoding parameter and the high frequency encoding parameter are obtained, encoding of a signal is implemented, so that the signal can be transferred to a decoder side for restoration.

Optionally, the audio signal encoding apparatus 300 may further include a bitstream generating unit 370 configured to generate a coded bitstream according to the low frequency encoding parameter and the high frequency encoding parameter, so as to send the encoded bitstream to the decoder side.

For operations performed by each unit of the audio signal encoding apparatus shown in FIG. 3, refer to description with reference to the audio signal encoding method in FIG. 1.

In the foregoing audio signal encoding apparatus in this embodiment of the present invention, a synthesizing unit 350 weights a high band excitation signal and random noise using a voiced degree factor, so as to obtain a synthesized excitation signal, and a characteristic of a high band signal may be more accurately presented based on a voiced signal, thereby improving an encoding effect.

Figure 5:
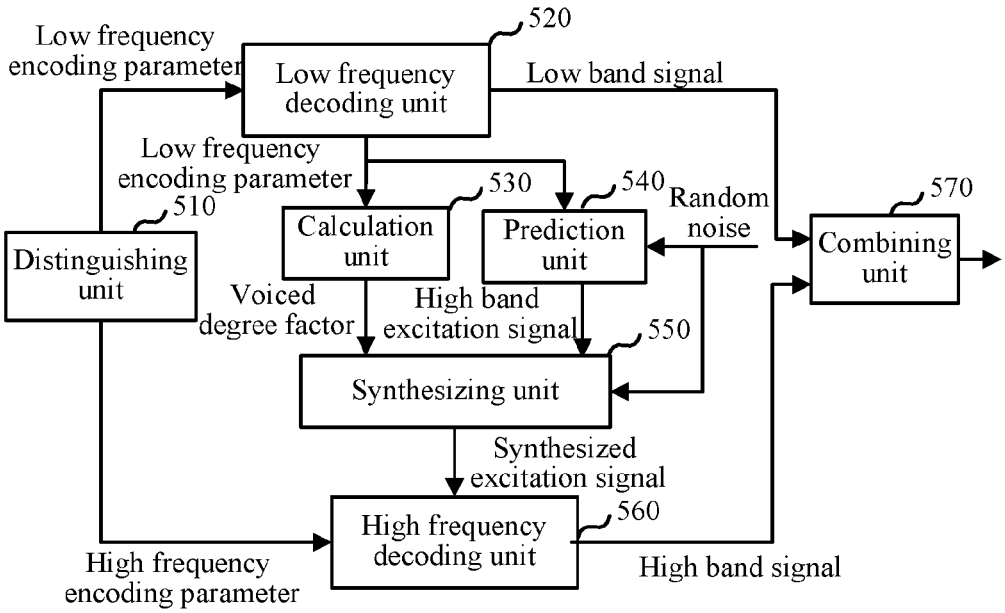
FIG. 5 is a schematic block diagram of an audio signal decoding apparatus according to an embodiment of the present invention.

FIG. 5 is a schematic block diagram of an audio signal decoding apparatus 500 according to an embodiment of the present invention. The audio signal decoding apparatus 500 includes a distinguishing unit 510 configured to distinguish a low frequency encoding parameter and a high frequency encoding parameter in encoded information; a low frequency decoding unit 520 configured to decode the low frequency encoding parameter to obtain a low band signal; a calculation unit 530 configured to calculate a voiced degree factor according to the low frequency encoding parameter, where the voiced degree factor is used to indicate a degree of a voiced characteristic presented by a high band signal; a prediction unit 540 configured to predict a high band excitation signal according to the low frequency encoding parameter; a synthesizing unit 550 configured to weight the high band excitation signal and random noise using the voiced degree factor, so as to obtain a synthesized excitation signal; a high frequency decoding unit 560 configured to obtain the high band signal based on the synthesized excitation signal and the high frequency encoding parameter; and a combining unit 570 configured to combine the low band signal and the high band signal to obtain a final decoded signal.

After receiving an encoded signal, the distinguishing unit 510 provides a low frequency encoding parameter in the encoded signal for the low frequency decoding unit 520, and provides a high frequency encoding parameter in the encoded signal for the high frequency decoding unit 560. The low frequency encoding parameter and the high frequency encoding parameter are parameters that are transferred from an encoder side and used to restore a low band signal and a high band signal. The low frequency encoding parameter may include, for example, an algebraic codebook, an algebraic codebook gain, an adaptive codebook, an adaptive codebook gain, a pitch period, and another parameter, and the high frequency encoding parameter may include, for example, an LPC coefficient, a high frequency gain adjustment parameter, and another parameter.

The low frequency decoding unit 520 decodes the low frequency encoding parameter to obtain the low band signal. A specific decoding mode is corresponding to an encoding manner of the encoder side. In addition, the low frequency decoding unit 520 further provides a low frequency encoding parameter such as the algebraic codebook, the algebraic codebook gain, the adaptive codebook, the adaptive codebook gain, or the pitch period for the calculation unit 530 and the prediction unit 540, where the calculation unit 530 and the prediction unit 540 may also directly acquire a required low frequency encoding parameter from the distinguishing unit 510.

The calculation unit 530 is configured to calculate the voiced degree factor according to the low frequency encoding parameter, where the voiced degree factor is used to indicate the degree of the voiced characteristic presented by the high band signal. The calculation unit 530 may calculate the voiced degree factor voice_fac according to the low frequency encoding parameter obtained using the low frequency decoding unit 520, and for example, the calculation unit 530 may calculate the voiced degree factor voice_fac according to the foregoing formula (1). Then, the voiced degree factor is used to obtain the synthesized excitation signal, where the synthesized excitation signal is transferred to the high frequency decoding unit 560 to obtain the high band signal.

The prediction unit 540 and the synthesizing unit 550 are respectively the same as the prediction unit 340 and the synthesizing unit 350 in the audio signal encoding apparatus 300 in FIG. 3. Therefore, for structures of the prediction unit 540 and the synthesizing unit 550, refer to description in FIG. 4. For example, in one implementation, the prediction unit 540 includes both a second modification component 450 and a prediction component 460; in another implementation, the prediction unit 540 merely includes the prediction component 460. For the synthesizing unit 550, in one implementation, the synthesizing unit 550 includes a pre-emphasis component 410, a weighting component 420, and a de-emphasis component 430; in another implementation, the synthesizing unit 550 includes a first modification component 440 and the weighting component 420; and in still another implementation, the synthesizing unit 550 includes the pre-emphasis component 410, the weighting component 420, the de-emphasis component 430, and the first modification component 440.

The high frequency decoding unit 560 obtains the high band signal based on the synthesized excitation signal and the high frequency encoding parameter. The high frequency decoding unit 560 performs decoding using a decoding technology corresponding to an encoding technology of the high frequency encoding unit in the audio signal encoding apparatus 300. As an example, the high frequency decoding unit 560 generates a synthesis filter using the LPC coefficient in the high frequency encoding parameter; restores a predicted high band signal after the synthesized excitation signal from the synthesizing unit 550 is filtered using the synthesis filter; and obtains a final high band signal after the predicted high band signal is adjusted using the high frequency gain adjustment parameter in the high frequency encoding parameter. In addition, the high frequency decoding unit 560 may also be implemented using various conventional or future technologies, and a specific decoding technology does not constitute a limitation to the present invention.

The combining unit 570 combines the low band signal and the high band signal to obtain the final decoded signal. A combining manner of the combining unit 570 is corresponding to a division manner that the division unit 310 performs a division operation in FIG. 3, so that decoding is implemented to obtain a final output signal.

In the foregoing audio signal decoding apparatus in this embodiment of the present invention, a high band excitation signal and random noise are weighted using a voiced degree factor, so as to obtain a synthesized excitation signal, and a characteristic of a high band signal may be more accurately presented based on a voiced signal, thereby improving a decoding effect.

Figure 6:
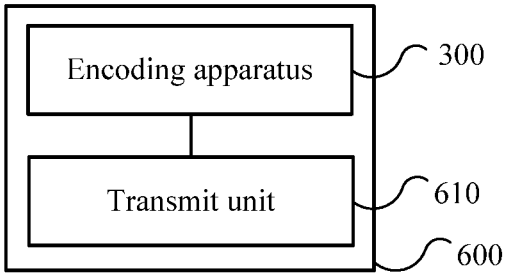
FIG. 6 is a schematic block diagram of a transmitter according to an embodiment of the present invention.

FIG. 6 is a schematic block diagram of a transmitter 600 according to an embodiment of the present invention. The transmitter 600 in FIG. 6 may include the audio signal encoding apparatus 300 shown in FIG. 3, and therefore, repeated description is appropriately omitted. In addition, the transmitter 600 may further include a transmit unit 610, which is configured to perform bit allocation for a high frequency encoding parameter and a low frequency encoding parameter that are generated by the audio signal encoding apparatus 300, so as to generate a bitstream and transmit the bitstream.

Figure 7:
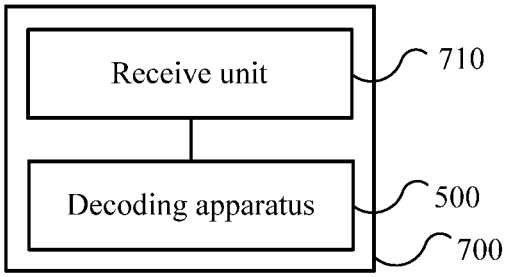
FIG. 7 is a schematic block diagram of a receiver according to an embodiment of the present invention.

FIG. 7 is a schematic block diagram of a receiver 700 according to an embodiment of the present invention. The receiver 700 in FIG. 7 may include the audio signal decoding apparatus 500 shown in FIG. 5, and therefore, repeated description is appropriately omitted. In addition, the receiver 700 may further include a receive unit 710, which is configured to receive an encoded signal, so as to provide the encoded signal for the audio signal decoding apparatus 500 for processing.

In another embodiment of the present invention, a communications system is further provided, where the communications system may include the transmitter 600 described with reference to FIG. 6 or the receiver 700 described with reference to FIG. 7.

Figure 8:
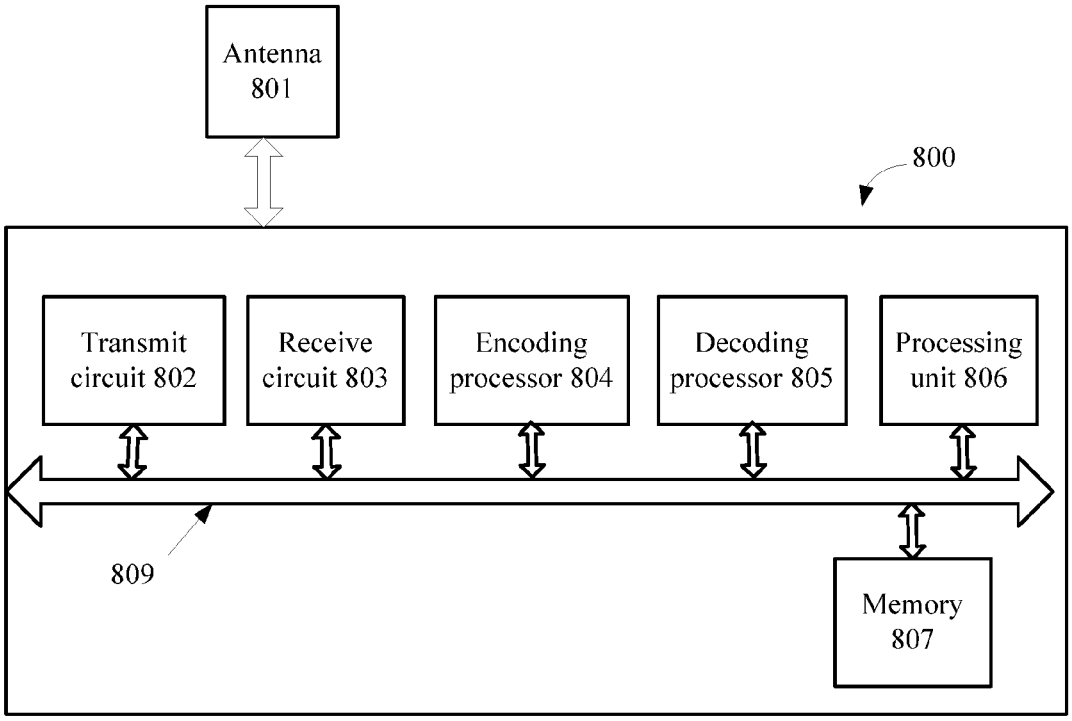
FIG. 8 is a schematic block diagram of an apparatus according to another embodiment of the present invention.

FIG. 8 is a schematic block diagram of an apparatus according to another embodiment of the present invention. An apparatus 800 in FIG. 8 may be configured to implement steps and methods in the foregoing method embodiments. The apparatus 800 may be applied to a base station or a terminal in various communications systems. In an embodiment in FIG. 8, the apparatus 800 includes a transmitting circuit 802, a receiving circuit 803, an encoding processor 804, a decoding processor 805, a processing unit 806, a memory 807, and an antenna 801. The processing unit 806 controls an operation of the apparatus 800, and the processing unit 806 may also be referred to as a central processing unit (CPU). The memory 807 may include a read-only memory (ROM) and a random access memory (RAM), and provides an instruction and data for the processing unit 806. A part of the memory 807 may further include a nonvolatile random access memory (NVRAM). In specific application, the apparatus 800 may be built in or the apparatus 800 itself may be a wireless communications device such as a mobile phone, and the apparatus 800 may further include a carrier accommodating the transmitting circuit 802 and the receiving circuit 803, so as to allow data transmission and receiving between the apparatus 800 and a remote location. The transmitting circuit 802 and the receiving circuit 803 may be coupled to the antenna 801. Components of the apparatus 800 are coupled together using a bus system 809, where in addition to a data bus, the bus system 809 includes a power bus, a control bus, and a state signal bus. However, for clarity of description, various buses are marked as the bus system 809 in the diagram. The apparatus 800 may further include the processing unit 806 for processing a signal, and in addition, the apparatus 800 further includes the encoding processor 804 and the decoding processor 805.

The audio signal encoding method disclosed in the foregoing embodiment of the present invention may be applied to the encoding processor 804 or be implemented by the encoding processor 804, and the audio signal decoding method disclosed in the foregoing embodiment of the present invention may be applied to the decoding processor 805 or be implemented by the decoding processor 805. The encoding processor 804 or the decoding processor 805 may be an integrated circuit chip and has a signal processing capability. In an implementation process, steps of the foregoing methods may be completed by means of an integrated logic circuit of hardware in the encoding processor 804 or the decoding processor 805 or instructions in a form of software. These instructions may be implemented and controlled by cooperating with the processor 806. The foregoing decoding processor configured to execute the methods disclosed in the embodiments of the present invention may be a general purpose processor, a digital signal processor (DSP), an application-specific integrated circuit (ASIC), a field programmable gate array (FPGA) or another programmable logic component, a discrete gate or a transistor logic component, or a discrete hardware assembly. The decoding processor may implement or execute the methods, steps, and logical block diagrams disclosed in the embodiments of the present invention. The general purpose processor may be a microprocessor or the processor may also be any conventional processor, translator, or the like. Steps of the methods disclosed with reference to the embodiments of the present invention may be directly executed and completed using a hardware decoding processor, or may be executed and completed using a combination of a hardware module and a software module in the decoding processor. The software module may be located in a mature storage medium in the art, such as a random access memory, a flash memory, a read-only memory, a programmable read-only memory, an electrically erasable programmable memory, or a register. The storage medium is located in the memory 807, and the encoding processor 804 or the decoding processor 805 reads information from the memory 807, and completes the steps of the foregoing methods in combination with hardware of the encoding processor 804 or the decoding processor 805. For example, the memory 807 may store an obtained low frequency encoding parameter, so as to provide the low frequency encoding parameter for the encoding processor 804 or the decoding processor 805 for use during encoding or decoding.

For example, the audio signal encoding apparatus 300 in FIG. 3 may be implemented by the encoding processor 804, and the audio signal decoding apparatus 500 in FIG. 5 may be implemented by the decoding processor 805. In addition, the prediction unit and the synthesizing unit in FIG. 4 may be implemented by the processor 806, and may also be implemented by the encoding processor 804 or the decoding processor 805.

In addition, for example, the transmitter 610 in FIG. 6 may be implemented by the encoding processor 804, the transmitting circuit 802, the antenna 801, and the like. The receiver 710 in FIG. 7 may be implemented by the antenna 801, the receiving circuit 803, the decoding processor 805, and the like. However, the foregoing examples are merely exemplary, and are not intended to limit the embodiments of the present invention to this specific implementation form.

The memory 807 stores an instruction that enables the processor 806 and/or the encoding processor 804 to implement the following operations: dividing a to-be-encoded time domain signal into a low band signal and a high band signal; encoding the low band signal to obtain a low frequency encoding parameter; calculating a voiced degree factor according to the low frequency encoding parameter, and predicting a high band excitation signal according to the low frequency encoding parameter, where the voiced degree factor is used to indicate a degree of a voiced characteristic presented by the high band signal; weighting the high band excitation signal and random noise using the voiced degree factor, so as to obtain a synthesized excitation signal; and obtaining a high frequency encoding parameter based on the synthesized excitation signal and the high band signal. The memory 807 stores an instruction that enables the processor 806 or the decoding processor 805 to implement the following operations: distinguishing a low frequency encoding parameter and a high frequency encoding parameter in encoded information; decoding the low frequency encoding parameter to obtain a low band signal; calculating a voiced degree factor according to the low frequency encoding parameter, and predicting a high band excitation signal according to the low frequency encoding parameter, where the voiced degree factor is used to indicate a degree of a voiced characteristic presented by a high band signal; weighting the high band excitation signal and random noise using the voiced degree factor, so as to obtain a synthesized excitation signal; obtaining the high band signal based on the synthesized excitation signal and the high frequency encoding parameter; and combining the low band signal and the high band signal to obtain a final decoded signal.

A communications system or communications apparatus according to an embodiment of the present invention may include a part of or all of the foregoing audio signal encoding apparatus 300, transmitter 600, audio signal decoding apparatus 500, receiver 700, and the like.

A person of ordinary skill in the art may be aware that, in combination with the examples described in the embodiments disclosed in this specification, units and algorithm steps may be implemented by electronic hardware or a combination of computer software and electronic hardware. Whether the functions are performed by hardware or software depends on particular applications and design constraint conditions of the technical solutions. A person skilled in the art may use different methods to implement the described functions for each particular application, but it should not be considered that the implementation goes beyond the scope of the present invention.

It may be clearly understood by a person skilled in the art that, for the purpose of convenient and brief description, for a detailed working process of the foregoing system, apparatus, and unit, reference may be made to a corresponding process in the foregoing method embodiments, and details are not described herein again.

In the several embodiments provided in the present application, it should be understood that the disclosed system, apparatus, and method may be implemented in other manners. For example, the described apparatus embodiment is merely exemplary. For example, the unit division is merely logical function division and may be other division in actual implementation. For example, a plurality of units or components may be combined or integrated into another system, or some features may be ignored or not performed.

The units described as separate parts may or may not be physically separate, and parts displayed as units may or may not be physical units, may be located in one position, or may be distributed on a plurality of network units. Some or all of the units may be selected according to actual needs to achieve the objectives of the solutions of the embodiments.

When the functions are implemented in the form of a software functional unit and sold or used as an independent product, the functions may be stored in a computer-readable storage medium. Based on such an understanding, the technical solutions of the present invention essentially, or the part contributing to the prior art, or some of the technical solutions may be implemented in a form of a software product. The software product is stored in a storage medium, and includes several instructions for instructing a computer device (which may be a personal computer, a server, or a network device) to perform all or some of the steps of the methods described in the embodiments of the present invention. The foregoing storage medium includes any medium that can store program code, such as a universal serial bus (USB) flash drive, a removable hard disk, a ROM, a RAM, a magnetic disk, or an optical disc.

The foregoing descriptions are merely specific implementation manners of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. An audio signal encoding method, comprising:

obtaining, by an audio signal encoder, an audio signal, wherein the audio signal comprises a low frequency band signal and a high frequency band signal;

obtaining, by the audio signal encoder, one or more low frequency encoding parameters by encoding the low frequency band signal;

calculating, by the audio signal encoder, a voiced factor according to the one or more low obtaining, by the audio signal encoder, a high frequency band excitation signal according to the one or more low frequency encoding parameters;

obtaining, by the audio signal encoder, a de-emphasized noise by performing a de-emphasis operation on a random noise, wherein an emphasis factor of the de-emphasis operation on the random noise is greater than 0 and less than 1;

obtaining, by the audio signal encoder, a synthesized excitation signal according to the de-emphasized noise, the high frequency band excitation signal and the voiced factor;

obtaining, by the audio signal encoder, a high frequency encoding parameter based on the synthesized excitation signal and the high frequency band signal; and outputting, by the audio signal encoder, a bitstream comprising the high frequency encoding parameter and the one or more low frequency encoding parameters.

2. The method according to claim 1, wherein obtaining a synthesized excitation signal according to the emphasized noise, the high band excitation signal and the voiced factor comprises:

obtaining the synthesized excitation signal by calculating a weighted sum of the high frequency band excitation signal and the emphasized noise;

wherein a weighting factor for calculating the weighted sum is obtained according to the voiced factor.

3. The method according to claim 1, wherein the emphasis factor of the de-emphasis operation on the random noise is a fixed value greater than 0 and less than 1.

4. An audio signal decoding method, comprising:

obtaining, by an audio signal decoder, a bitstream;

obtaining, by the audio signal decoder, a low frequency encoding parameter and a high frequency encoding parameter from the bitstream;

obtaining, by the audio signal decoder, a low frequency band signal according to the low frequency encoding parameter;

calculating, by the audio signal decoder, a voiced factor according to the low frequency encoding parameter;

obtaining, by the audio signal decoder, a high frequency band excitation signal according to the low frequency encoding parameter;

obtaining, by the audio signal decoder, a de-emphasized noise by performing a de-emphasis operation on a random noise, wherein an emphasis factor of the de-emphasis operation on the random noise is greater than 0 and less than 1;

obtaining, by the audio signal decoder, a synthesized excitation signal according to the de-emphasized noise, the high frequency band excitation signal and the voiced factor;

obtaining, by the audio signal decoder, a high frequency band signal based on the synthesized excitation signal and the high frequency encoding parameter;

combining, by the audio signal decoder, the low frequency band signal and the high frequency band signal to obtain an audio signal; and outputting, by the audio signal decoder, the audio signal.

5. The method according to claim 4, wherein obtaining the synthesized excitation signal according to the emphasized noise, the high frequency band excitation signal and the voiced factor comprises:

obtaining the synthesized excitation signal by calculating a weighted sum of the high frequency band excitation signal and the emphasized noise;

wherein a weighting factor for calculating the weighted sum is obtained according to the voiced factor.

6. The method according to claim 4, wherein the emphasis factor of the de-emphasis operation on the random noise is a fixed value greater than 0 and less than 1.

7. An audio signal encoding apparatus, comprising:

a processor and a memory storing computer-readable instructions for execution by the processor;

wherein the processor is configured to execute the instructions to:

obtain an audio signal, wherein the audio signal comprises a low frequency band signal and a high frequency band signal;

obtain one or more low frequency encoding parameters by encoding the low frequency band signal;

calculate a voiced factor according to the one or more low frequency encoding parameters;

obtain a high frequency band excitation signal according to the one or more low frequency encoding parameters;

obtain a de-emphasized noise by performing a de-emphasis operation on a random noise, wherein an emphasis factor of the de-emphasis operation on the random noise is greater than 0 and less than 1;

obtain a synthesized excitation signal according to the de-emphasized noise, the high frequency band excitation signal and the voiced factor;

obtain a high frequency encoding parameter based on the synthesized excitation signal and the high frequency band signal; and output a bitstream comprising the high frequency encoding parameter and the one or more low frequency encoding parameters.

8. The apparatus according to claim 7, wherein in obtaining a synthesized excitation signal according to the emphasized noise, the high band excitation signal and the voiced factor, the processor is configured to:

obtain the synthesized excitation signal by calculating a weighted sum of the high frequency band excitation signal and the emphasized noise;

wherein a weighting factor for calculating the weighted sum is obtained according to the voiced factor.

9. The apparatus according to claim 7, wherein the emphasis factor of the de-emphasis operation on the random noise is a fixed value greater than 0 and less than 1.

10. An audio signal decoding apparatus, comprising:

a processor and a memory storing computer-readable instructions for execution by the processor;

wherein the processor is configured to execute the instructions to:

obtain a bitstream;

obtain a low frequency encoding parameter and a high frequency encoding parameter from the bitstream;

obtain a low frequency band signal according to the low frequency encoding parameter;

calculate a voiced factor according to the low frequency encoding parameter;

obtain a high frequency band excitation signal according to the low frequency encoding parameter;

obtain a de-emphasized noise by performing a de-emphasis operation on a random noise, wherein an emphasis factor of the de-emphasis operation on the random noise is greater than 0 and less than 1;

obtain a synthesized excitation signal according to the de-emphasized noise, the high frequency band excitation signal and the voiced factor;

obtain a high frequency band signal based on the synthesized excitation signal and the high frequency encoding parameter;

combine the low frequency band signal and the high frequency band signal to obtain an audio signal; and output the audio signal.

11. The apparatus according to claim 10, wherein in obtaining the synthesized excitation signal according to the emphasized noise, the high frequency band excitation signal and the voiced factor, the processor is configured to:

obtain the synthesized excitation signal by calculating a weighted sum of the high frequency band excitation signal and the emphasized noise;

wherein a weighting factor for calculating the weighted sum is obtained according to the voiced factor.

12. The apparatus according to claim 10, wherein the emphasis factor of the de-emphasis operation on the random noise is a fixed value greater than 0 and less than 1.

* * * * *